US008549967B1

(12) United States Patent
Smithwick, Jr.

(10) Patent No.: US 8,549,967 B1
(45) Date of Patent: Oct. 8, 2013

(54) CORRUGATED BOARD CUTTING DIE HAVING A SCORING OR CUTTING ASSEMBLY THAT REDUCES CORRUGATED BOARD CRACKING DURING SCORING AND CUTTING OPERATIONS

(75) Inventor: James M. Smithwick, Jr., Holly Springs, NC (US)

(73) Assignee: Container Graphics Corporation, Cary, NC (US)

( * ) Notice: Subject to any disclaimer, the term of this patent is extended or adjusted under 35 U.S.C. 154(b) by 359 days.

(21) Appl. No.: 12/959,778

(22) Filed: Dec. 3, 2010

(51) Int. Cl.
*B26D 7/00* (2006.01)

(52) U.S. Cl.
USPC ..... 83/117; 83/139

(58) Field of Classification Search
USPC ..... 83/113, 115, 116, 117, 139; 493/59, 493/60, 365, 396, 402
See application file for complete search history.

(56) References Cited

U.S. PATENT DOCUMENTS 3,128,681 A * 4/1964 Miller ..... 493/365
4,224,851 A * 9/1980 Imai ..... 83/117
4,499,802 A * 2/1985 Simpson ..... 83/117
4,856,393 A * 8/1989 Braddon ..... 83/50
5,176,613 A * 1/1993 Cavlin et al. ..... 493/354
6,688,198 B2 * 2/2004 Matsumoto et al. ..... 83/139
8,201,482 B2 * 6/2012 Vossen ..... 83/55
2011/0203435 A1 * 8/2011 Smithwick ..... 83/114

* cited by examiner

*Primary Examiner* — Stephen Choi
(74) *Attorney, Agent, or Firm* — Coats and Bennett PLLC

(57) ABSTRACT

A scoring or cutting assembly forms a part of a cutting die used to score and cut corrugated board. The scoring or cutting assembly includes a cutting or scoring rule secured to a die board. First and second elastomers are secured on the die board such that the scoring or cutting rule extends between the elastomers and there is defined a space between the scoring or cutting rule in each of the elastomers. There is also provided a pair of retainers, each retainer being secured to the die board adjacent an outboard side of the elastomers. During a cutting or scoring operation, the elastomers engage the corrugated board on opposite sides of the scoring or cutting rule and apply and inward force to the corrugated board towards the scoring or cutting rule. This causes the corrugated board to resist cracking on opposite sides of the scoring or cutting rule.

16 Claims, 3 Drawing Sheets

CORRUGATED BOARD CUTTING DIE HAVING A SCORING OR CUTTING ASSEMBLY THAT REDUCES CORRUGATED BOARD CRACKING DURING SCORING AND CUTTING OPERATIONS

FIELD OF THE INVENTION

The present invention relates to corrugated board die cutting processes, more particularly to a corrugated board cutting die for scoring and cutting corrugated board.

BACKGROUND OF THE INVENTION

Corrugated cutting dies are known and are widely used throughout the United States and the world for scoring and cutting sheets of corrugated board that are often used to make corrugated containers or other corrugated products. These cutting dies may be rotary cutting dies or flat cutting dies. One of the problems that arises in scoring and cutting corrugated board is that of corrugated board cracking that occurs along scoring or cutting lines that are produced during a corrugated board scoring or cutting operation. This is particularly true today because of the use of recycled paper. Many businesses are using recycled corrugated board, and when this corrugated board is recycled and reused over and over again, the fibers tend to get shorter and shorter, and thus the corrugated board is not as strong and is more prone to cracking. When the corrugated board is dry, this only makes the problem worse.

Therefore, there has been and continues to be a need for a corrugated board cutting die that addresses the cracking problem that occurs often along scoring and cutting lines produced in a corrugated board cutting and scoring operation.

SUMMARY OF THE INVENTION

The present invention relates to a corrugated board cutting die that includes a die board having one or more scoring or cutting assemblies for reducing or eliminating cracking of the corrugated board during a scoring or cutting operation.

In one embodiment the cutting board is provided with a scoring or cutting assembly that is designed to reduce cracking in the corrugated board during a scoring or cutting operation. The scoring or cutting assembly includes a scoring rule or cutting blade (such as a cutting rule or punch) secured on the die board. Disposed on at least one side of the scoring rule or cutting blade is an elastomer. The elastomer is spaced from the scoring rule or cutting blade such that an open space is defined between the scoring rule or cutting blade and the elastomer. A retainer is secured to the die board adjacent the outside edge of the elastomer. During a cutting or scoring operation, the retainer generally prevents the elastomer from moving outwardly past the retainer. Further during the cutting or scoring operation the elastomer engages a portion of the corrugated board adjacent the scoring rule or cutting blade and generally prevents the corrugated board from cracking in the area and vicinity of where the elastomer engages the corrugated board and the initial gap area between the elastomer and scoring rule or cutting blade.

In one embodiment, the present invention entails a scoring or cutting assembly having a scoring or cutting rule secured on the die board. First and second elastomers are secured on the die board such that the scoring or cutting rule extends between the elastomers and there is defined a space between the scoring or cutting rule and each of the elastomers. Further, there is provided a pair of retainers, each retainer being secured to the die board adjacent an outboard side of one of the elastomers. During a scoring or cutting operation, the elastomers engage the corrugated board on opposite sides of the scoring or cutting rule and apply an inward force to the corrugated board towards the scoring or cutting rule. This causes the corrugated board to resist cracking on opposite sides of the scoring or cutting rule.

Other objects and advantages of the present invention will become apparent and obvious from a study of the following description and the accompanying drawings which are merely illustrative of such invention.

DESCRIPTION OF EXEMPLARY EMBODIMENTS

Figure 1:
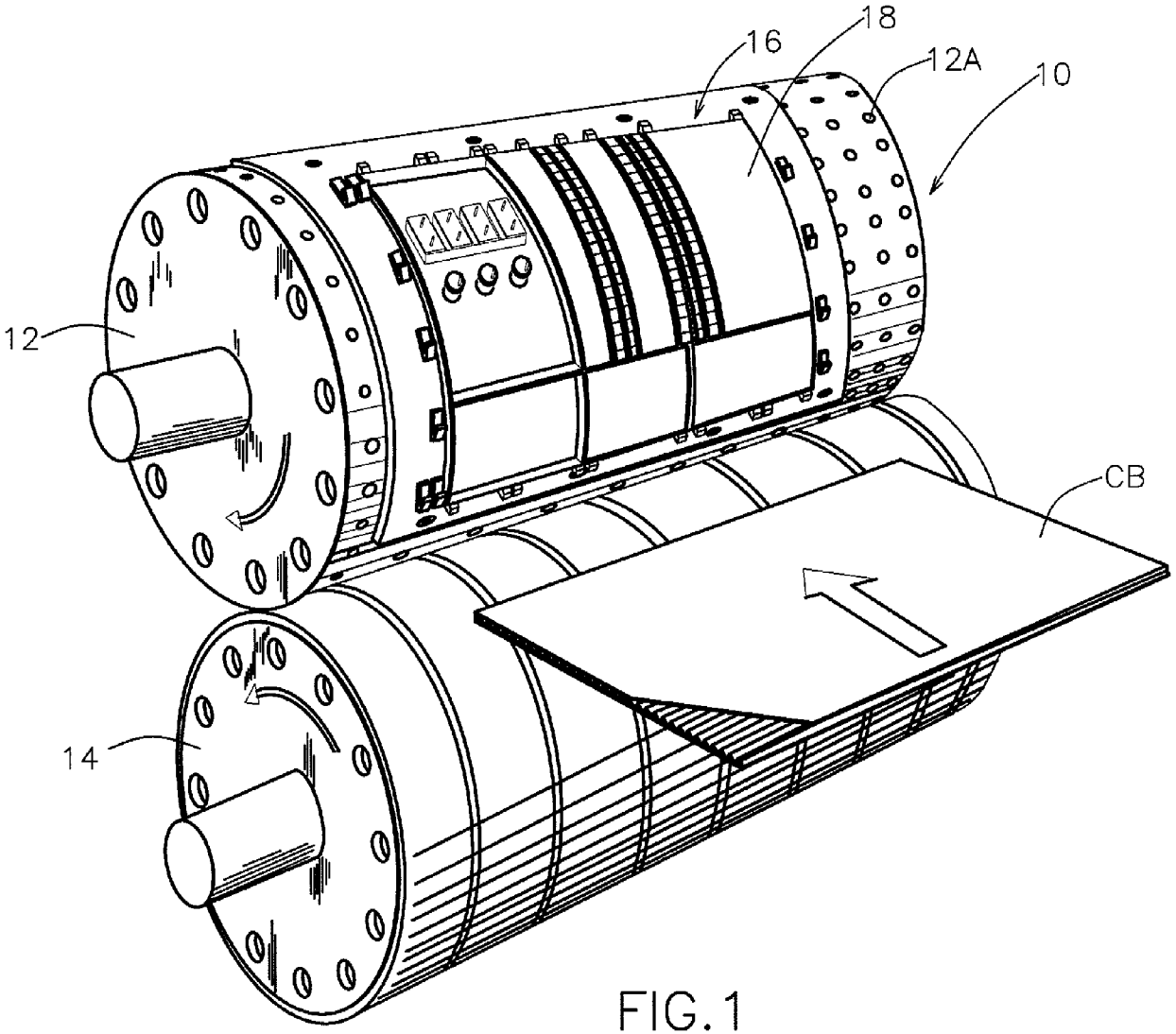
FIG. 1 is a perspective view of a rotary cutting die apparatus including a cylinder, anvil, and a corrugated board cutting die.

With further reference to the drawings, particularly FIG. 1, there is shown therein a rotary die cutting apparatus indicated generally by the numeral 10. Rotary cutting die apparatus 10 includes a cylinder 12 and an anvil 14. Cylinder 12 and anvil 14 are conventional and form a part of a conventional rotary die cutting apparatus. Cylinder 12 is adapted to receive a corrugated board cutting die indicated generally by the numeral 16. Cutting die 16 is bolted or secured to the cylinder 12. In a die scoring and cutting operation, corrugated board CB, shown in FIG. 1, is fed through the nip that exists between the cylinder 12 and anvil 14. As the cutting die 16 rotates with the cylinder 12, various components of the cutting die, such as scoring rules, cutting rules, product ejectors, scrap ejectors, etc. engage the corrugated board CB and perform an operation on the corrugated board.

Cutting die 16 includes a die board 18. In this example, die board 18 is of a circular or arcuate configuration. Cylinder 12 includes threaded bores 12A. Further, die board 18 includes fastener openings that permit bolts or other fastening means to extend there through and to be secured to the cylinder 12. This secures the die board 18 to the cylinder 12. As noted above, die board 18 includes numerous die elements or parts that engage and operate on the corrugated board CB. In the embodiment illustrated in FIG. 1, the die board 18 is a circular die board and is especially suited for use in the rotary die cutting apparatus 10. It is understood and appreciated, however, that the present invention is equally suitable for use in flat dies. There exists problems or concerns with the corrugated board cracking along scoring or cutting lines in flat die applications.

As noted above, a typical die board is provided with one or more scoring rules, one or more cutting rules or blades, scrap ejectors, product ejectors, and numerous other types and forms of working elements. The particular problem addressed by the present invention is that of the corrugated board cracking adjacent scoring or cutting lines. The present invention presents a die board having an assembly that addresses the cracking problem.

Figure 2:
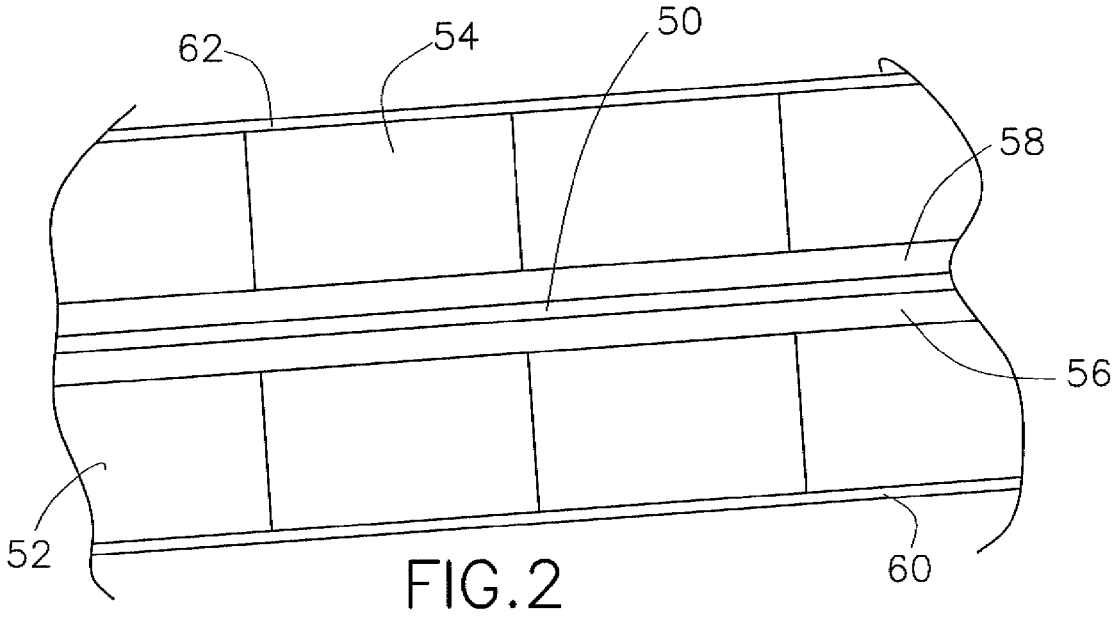
FIG. 2 is a fragmentary top plan view of a portion of the corrugated board cutting die showing a scoring rule, elastomers, and a pair of outer retainers.
Figure 3:
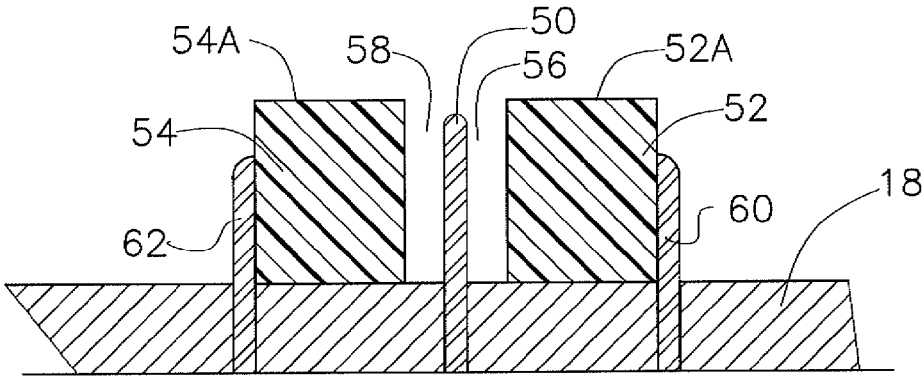
FIG. 3 is a fragmentary cross-sectional view taken through FIG. 2.
Figure 4:
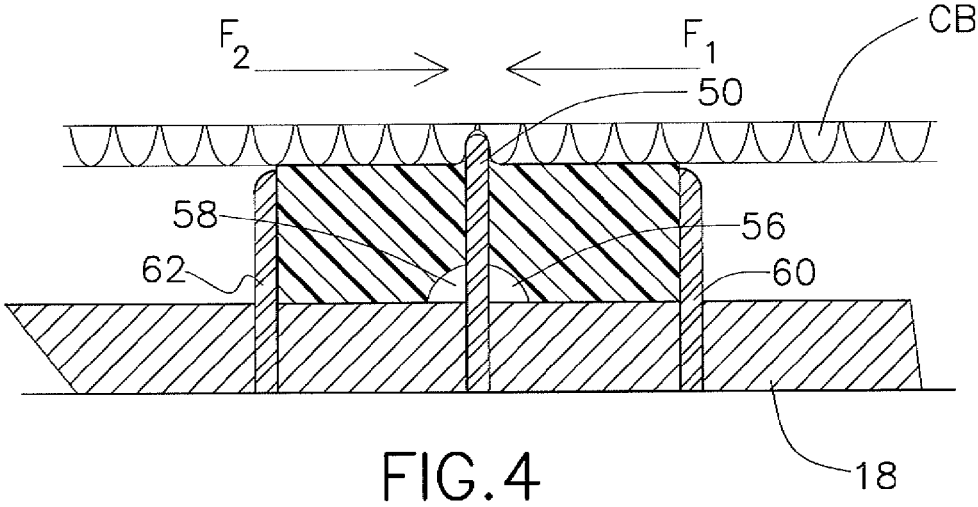
FIG. 4 is a sectional view similar to FIG. 3, but showing a piece of corrugated board being scored by a scoring rule.

Turning to the embodiment shown in FIGS. 2-4, there is illustrated a scoring assembly that is mounted on the die board 18. In this embodiment, the scoring assembly includes a single scoring rule or cutting rule 50. The particular device shown in FIGS. 2-4 is a scoring rule, but it is understood and appreciated that this could be a cutting rule. Disposed on one side of the scoring or cutting rule 50 is a first elastomer 52. Disposed on the other side of the scoring or cutting rule 50 is a second elastomer 54. The scoring or cutting rule 50 is secured and anchored within the die board 18 and the first and second elastomers 52 and 54 are likewise secured and anchored to the die board. Each elastomer includes an exposed or working surface. This is shown in the drawings as exposed surface 52A and exposed surface 54A. Sometimes these exposed surfaces are referred to as upper surfaces. The die board 18 may assume various orientations, and consequently the exposed or working surfaces 52A and 54A could assume upper, lower, or even sideways orientations. The term upper surface, as used herein means a surface or a surface portion opposite the die board 18. The exposed surfaces 52A and 54A can assume various shapes. They may be angled or even include compound angled surfaces.

In the particular embodiments illustrated in FIGS. 2-7, the elastomers 52 and 54 are shown as relatively short segments. It is to be understood that the elastomers 52 and 54 could be continuous and not made up of a series of segmented elastomers.

Elastomers 52 and 54 are particularly spaced with respect to the scoring or cutting rule 50. That is, they are spaced outwardly from the cutting or scoring rule 50. This, as shown in FIGS. 3 and 4, defines or provides for a space between each elastomer 52 and 54 and the scoring or cutting rule 50. More particularly, there is a first space 56 defined between the scoring or cutting rule 50 and the first elastomer 52. There is a second space 58 that is disposed between the scoring or cutting rule 50 and the second elastomer 54. As will be appreciated from the subsequent portions of this disclosure, spaces 56 and 58 contribute to the reduction of cracking that often results from cutting or scoring operations.

As seen in FIGS. 2-4, there is provided a first retainer 60 secured to the die board 18 adjacent the outer side of the first elastomer 52. Likewise, a second retainer 62 is mounted on the die board and extends upwardly adjacent the outer side of the second elastomer 54. Various materials can be utilized for the first and second retainers 60 and 62. In one embodiment, the retainers 60 and 62 can simply comprise a scoring rule. Retainers 60 and 62 engage and hold and retain the respective elastomers 52 and 54 such that the during the die cutting operation, the elastomers 52 and 54 are prevented from moving outwardly or from being deformed in an outward direction past the retainers 60 and 62. Note that the height of the retainers 60 and 62 are such that the upper edges thereof do not engage or penetrate the corrugated board CB during the cutting or scoring operation. See FIG. 4 for example. The objective of the design shown in FIGS. 2-4 is to urge the upper or exposed portions of the elastomers 52 and 54 as viewed in FIGS. 3 and 4 inwardly towards the scoring or cutting rule 50. The retainers 60 and 62 retain the elastomers 52 and 54 and cause them, during a die cutting operation, to deform inwardly as shown in FIG. 4 and not outwardly past the retainers.

Note in FIG. 4 that during a typical die cutting operation that the corrugated board is brought into engagement or contact with the exposed surfaces 52A and 54A of the first and second elastomers 52 and 54. The corrugated board is pressed or moved towards the die board 18 causing the exposed portions of the elastomers 52 and 54 to deform. See FIG. 4. However, in deforming, the upper or exposed portions of the elastomers 52 and 54 engage the corrugated board CB on opposite sides of the scoring or cutting rule 50 and tend to create an inward force on both sides of the scoring or cutting rule, and this force is represented by the force vectors $F_1$ and $F_2$ shown in FIG. 4. The engagement of the exposed surfaces 52A and 54A with the corrugated board CB during a scoring or cutting operation tends to reduce cracking along a resulting scoring or cutting line on the corrugated board CB. The pressure or force exerted by the upper surfaces 52A and 54A will generally prevent the corrugated board in this area from being stretched outwardly, and thereby, the engagement of the elastomers 52 and 54 with the corrugated board will reduce the tendency of the corrugated board to crack on opposite sides of the scoring or cutting rule 50.

Figure 5:
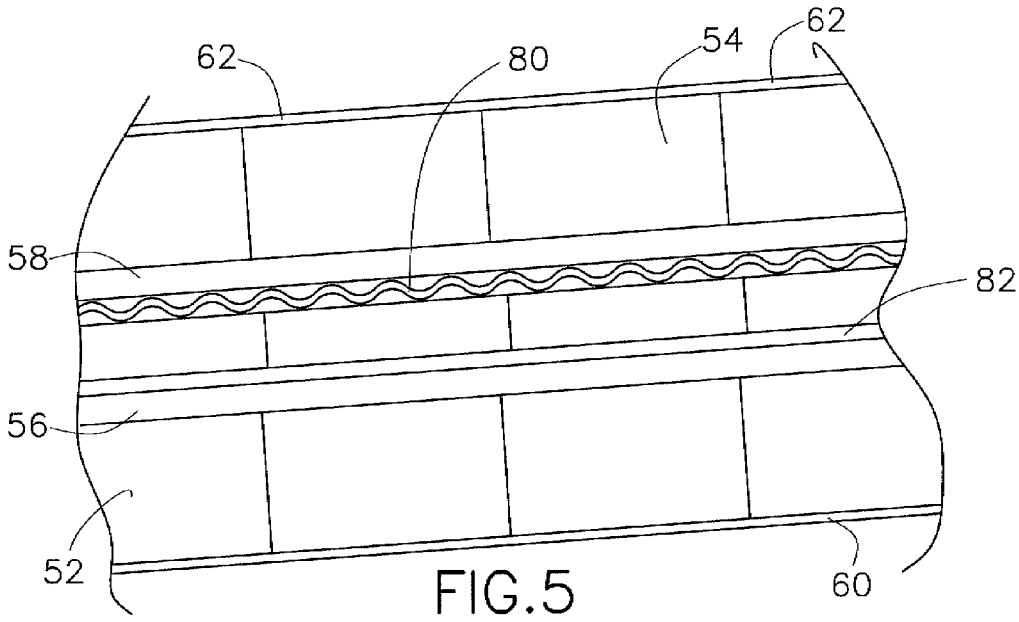
FIG. 5 is a fragmentary plan view similar to FIG. 2, but showing a different embodiment that comprises a pair of scoring rules.
Figure 6:
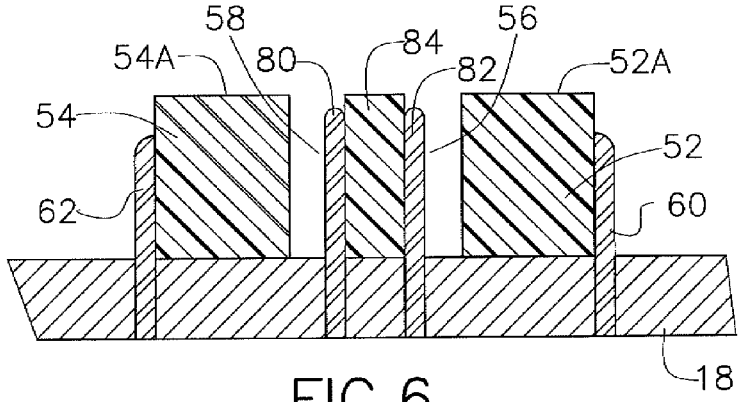
FIG. 6 is a sectional view taken through the assembly of FIG. 5.
Figure 7:
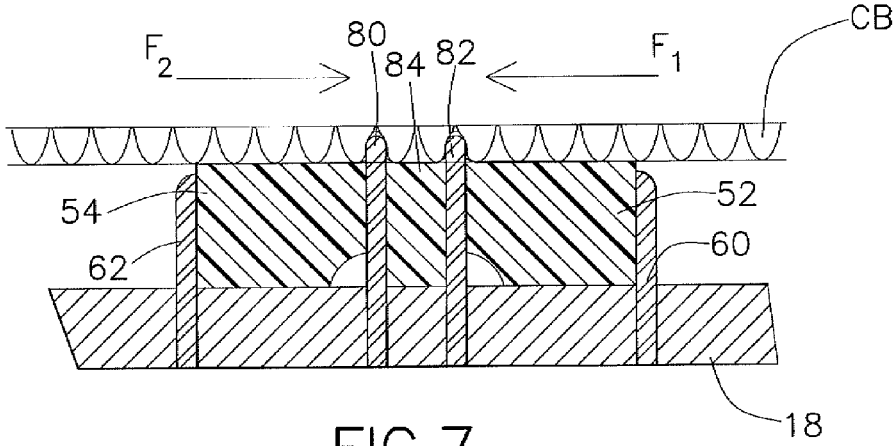
FIG. 7 is a view similar to FIG. 6, but illustrates a piece of corrugated board being scored by two scoring rules.

Now, turning to FIGS. 5-7, another embodiment is shown for a die board that includes a scoring or cutting assembly that is designed to reduce cracking of a corrugated board. In this case, the assembly includes a pair of scoring rules 80 and 82. Scoring rule 80 includes an upper undulating edge, while scoring rule 82 includes a conventional arcuate or rounded shape scoring edge. It is appreciated that other forms of scoring or cutting rules could be included. The design shown in FIGS. 5-7 is similar to that discussed above with respect to FIGS. 2-4 with the exception that there is shown a pair of scoring rules 80 and 82 and a middle elastomer 84. The middle elastomer 84 is disposed between the scoring rules 80 and 82. Otherwise, the elastomers and retainers are similar in structure and function to those discussed with respect to the embodiment shown in FIGS. 2-4. Note during the scoring operation, the corrugated board CB engages the exposed surfaces 52A and 54A of the elastomers 52 and 54. During the scoring operation, the upper or exposed portions of the elastomers 52 and 54 are compressed, causing the upper portion of the elastomers to fill a portion of the first and second spaces 56 and 58. In the process, the elastomers 52 and 54 engage one side of the corrugated board CB and excert inward forces toward the pair of scoring rules 80 and 82. This reduces cracking of the corrugated board along scoring lines resulting from the engagement of the scoring rules 80 and 82 with the corrugated board CB.

In the embodiments discussed above and shown in the drawings, there is provided elastomers 52 and 54 on opposite sides of a scoring rule or cutting rule, or even on opposite sides of a pair of scoring or cutting rules. There are occasions where the scoring or cutting assembly will only utilize the elastomer and retainer on one side of the scoring or cutting rule. For example, a cutting rule can be utilized on a die board to cut scrap or trim from the corrugated board and in that case there may only be a need for the elastomer and retainer to be disposed on one side of the cutting rule. Again the elastomer is utilized to prevent or minimize cracking of the corrugated board and hence the elastomer would be spaced outwardly from the cutting rule. Again the retainer is disposed adjacent an outer side or edge of the elastomer and prevents the elastomer from being deformed outwardly past the retainer during the cutting operation. Another example where the elastomer and retainer would be disposed on only one side of the cutting device is in the case of a punch. Typically a punch includes a cutting edge, such as for example a circular cutting edge. The punch is effective to cut material from the corrugated board. In this case the elastomer that is effective to reduce cracking the corrugated board is disposed outwardly of the cutting edge of the punch and again is spaced such that there is a defined space between the elastomer and the cutting edge of the punch. A retainer is disposed along the outer side or outer edge of the elastomer that extends around the punch. Again the retainer prevents the elastomer from being deformed outwardly past the retainer during a punching operation.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

The invention claimed is:

1. A cutting die for cutting corrugated board wherein the cutting die during a cutting or scoring operation, reduces cracking in the corrugated board along a scoring or cutting line, the cutting die comprising:

a. a die board having at least one scoring rule or cutting blade;

b. a first elastomer mounted on the die board on a first side of the scoring rule or cutting blade;

c. a second elastomer mounted on the die board on a second side of the scoring rule or cutting blade;

d. the first elastomer spaced outwardly from the scoring rule or cutting blade such that there is a first space defined between the scoring rule or cutting blade and the first elastomer;

e. the second elastomer spaced outwardly from the scoring rule or cutting blade such that there is a second space defined between the scoring rule or cutting blade and the second elastomer;

f. a first retainer mounted on the die board adjacent an outside edge of the first elastomer for engaging and retaining the first elastomer during the scoring or cutting operation, and wherein the first elastomer lies between the scoring rule or cutting blade and the first retainer;

g. a second retainer mounted on the die board adjacent an outside edge of the second elastomer for engaging and retaining the second elastomer during the scoring or cutting operation, wherein the second elastomer lies between the scoring rule or cutting blade and the second retainer; and h. wherein the scoring rule or cutting blade, the first and second elastomers, and the first and second retainers are configured and spaced such that during the scoring or cutting operation, exposed surfaces of the first and second elastomers engage portions of the corrugated board on opposite sides of the scoring rule or cutting blade so as to move the first and second elastomers inwardly towards the scoring rule or cutting blade and not substantially outwardly past the first and second retainers to at least partially fill the first and second spaces and urge the engaged portions of the corrugated board inwardly towards the scoring rule or cutting blade so as to reduce the tendency of the corrugated board to crack on opposite sides of the scoring or cutting line.

2. The cutting die of claim 1 wherein in a no load condition the first and second elastomers extend beyond the scoring rule or cutting blade such that exposed edges of the scoring rule or cutting blade in a no load condition are recessed with respect to the exposed surfaces of the elastomers.

3. The cutting die of claim 1 wherein each of the first and second elastomers includes a series of elastomer segments.

4. The cutting die of claim 3 wherein the elastomer segments of each of the first and second elastomers are aligned and disposed in end-to-end relationship.

5. A cutting die for cutting corrugated board wherein during a cutting or scoring operation the cutting die reduces the tendency of the corrugated board to crack along a scoring or cutting line, the cutting die comprising:

a. a die board;

b. a pair of spaced apart cutting or scoring rules wherein the pair of cutting or scoring rules includes a pair of scoring rules, a pair of cutting rules, or a scoring rule and a cutting rule;

c. a first elastomer mounted on the die board on a first side of the pair of cutting or scoring rules;

d. a second elastomer mounted on the die board on second side of the pair of cutting or scoring rules;

e. the first elastomer spaced outwardly from one of the pair of cutting or scoring rules such that there is a first space defined between the first elastomer and one of the pair of the cutting or scoring rules;

f. the second elastomer spaced outwardly from the other one of the pair of cutting or scoring rules such that there is a second space defined between the second elastomer and the other one of the pair of cutting or scoring rules;

g. a first retainer mounted on the die board adjacent an outside edge of the first elastomer for engaging and retaining the elastomer during the scoring or cutting operation, and wherein the first elastomer lies between the pair of scoring or cutting rules and the first retainer;

h. a second retainer mounted on the die board adjacent an outside edge of the second elastomer for engaging and retaining the second elastomer during a scoring or cutting operations and wherein the second elastomer lies between the pair of cutting or scoring rules and the second retainer; and i. wherein the pair of scoring or cutting rules, first and second elastomers, and the first and second retainers are configured and spaced on the die board such that during the scoring or cutting operation, exposed surfaces of the first and second elastomers engage portions of the corrugated board on opposite sides of the pair of cutting or scoring rules so as to move the first and second elastomers inwardly towards the pair of scoring or cutting rules and not substantially outwardly past the first and second retainers to at least partially fill the first and second spaces and urge the engaged portions of the corrugated board inwardly towards the pair of cutting or scoring rules, reducing the tendency of the corrugated board to crack adjacent the scoring or cutting lines produced during the scoring or cutting operation.

6. The cutting die of claim 5 wherein in a no load condition, the first and second elastomers extend beyond the pair of scoring or cutting rules such that exposed edges of the pair of scoring or cutting rules in the no load condition are recessed with respect to the exposed surfaces of the elastomers.

7. The cutting die of claim 5 wherein each of the first and second elastomers includes a series of elastomer segments.

8. The cutting die of claim 7 wherein the elastomer segments of each of the first and second elastomers are aligned and disposed in end-to-end relationship.

9. A method of scoring corrugated board with a rotary cutting die apparatus which includes a cylinder, rotary anvil, die board mounted on the cylinder, a scoring rule mounted on the die board, first and second elastomers mounted on the die board and spaced outwardly from the scoring rule such that an open space is formed between the scoring rule and each of the first of the second elastomers, and first and second retainers mounted on the die board outwardly of the first and second elastomers for engaging the first and second elastomers and limiting their outward movement, the method comprising:

a. engaging the corrugated board with the cutting die apparatus by feeding the corrugated board between the die board and the rotary anvil;

b. engaging portions of the corrugated board on each side of the scoring rule with the first and second elastomers;

c. retaining the elastomers with the first and second retainers and generally preventing the elastomers from moving outwardly past the first and second retainers during the scoring operation; and d. deforming the first and second elastomers while engaged with portions of the corrugated board on opposite sides of the scoring rule and causing the first and second elastomers to move inwardly towards the scoring rule and not substantially outwardly past the first and second retainers and at least partially filling the open spaces formed between the scoring rule and each of the first and second elastomers, wherein the inward deformation of the first and second elastomers applies an inwardly directed force to the portions of the corrugated board engaged by the first and second elastomers and thereby reduces the tendency of the corrugated board to crack on opposite sides of a scoring line produced during the scoring operation.

10. The method of claim 9 wherein each elastomer includes an exposed surface that engages a portion of the corrugated board during a scoring operation and wherein a portion of each elastomer including the exposed surface moves generally inwardly and towards the scoring rule during the scoring operation.

11. The method of claim 9 wherein there is only one scoring rule disposed between the first and second elastomers.

12. The method of claim 9 wherein there is a pair of scoring rules disposed between the first and second elastomers.

13. A cutting die for cutting corrugated board wherein the cutting die during a cutting or scoring operation, reduces cracking the corrugated board along a scoring or cutting line, the cutting die comprising:

a. a die board having at least one scoring rule or cutting blade;

b. an elastomer mounted on the die board;

c. the elastomer spaced outwardly from the scoring or cutting rule such that there is an open space defined between the scoring rule or cutting blade and the elastomer;

d. a retainer mounted on the die board adjacent an outside edge of the elastomer for engaging and retaining the elastomer during the cutting or scoring operation such that during the cutting and scoring operation the elastomer is generally prevented from deforming and moving outwardly past the retainer; and e. wherein the scoring rule or cutting blade, elastomer, and retainer are configured and spaced such that during the scoring or cutting operation, exposed surfaces of the elastomer engage a portion of the corrugated board so as to move the elastomer inwardly towards the scoring rule or cutting blade and not substantially outwardly past the retainer to at least partially fill the open space and urge the engaged portion of the corrugated board towards the scoring rule or cutting blade so as to reduce the tendency of the corrugated board to crack along one side of the scoring or cutting line.

14. The cutting die of claim 13 wherein the retainer has a height less than the scoring rule or cutting blade and wherein during the scoring or cutting operation, an exposed edge of the retainer is spaced from the corrugated board.

15. The cutting die of claim 13 wherein the elastomer includes a series of elastomer segments disposed one adjacent the other.

16. A rotary cutting die for cutting corrugated board wherein the cutting die during a scoring operation, reduces cracking in the corrugated board along a scoring line, the cutting die comprising:

a. a curved die board configured to be mounted on a cylinder and having at least one scoring rule mounted thereon and wherein the die board is configured to score corrugated board passing through a nip between the die board and a rotary anvil;

b. a first elastomer mounted on the die board on a first side of the scoring rule;

c. a second elastomer mounted on the die board on a second side of the scoring rule;

d. the first elastomer spaced outwardly from the scoring rule such that there is a first space defined between the scoring rule and the first elastomer;

e. the second elastomer spaced outwardly from the scoring rule such that there is a second space defined between the scoring rule and the second elastomer;

f. a first retainer mounted on the die board adjacent an outside edge of the first elastomer for engaging and retaining the first elastomer during the scoring operation, and wherein the first elastomer lies between the scoring rule and the first retainer;

g. a second retainer mounted on the die board adjacent an outside edge of the second elastomer for engaging and retaining the second elastomer during the scoring operation, wherein the second elastomer lies between the scoring rule and the second retainer; and h. wherein the scoring rule, the first and second elastomers, and the first and second retainers are configured and spaced such that during the scoring operation, exposed surfaces of the first and second elastomers engage portions of the corrugated board on opposite sides of the scoring rule so as to move the first and second elastomers inwardly towards the scoring rule and not substantially outwardly past the first and second retainers to at least partially fill the first and second spaces and urge the engaged portions of the corrugated board inwardly towards the scoring rule so as to reduce the tendency of the corrugated board to crack on opposite sides of the scoring.

* * * * *